US007682269B1

(12) United States Patent
Gait

(10) Patent No.: US 7,682,269 B1
(45) Date of Patent: Mar. 23, 2010

(54) LACROSSE HEAD WITH VERTICAL POCKET ATTACHMENTS

(75) Inventor: Paul Gait, Altamont, NY (US)

(73) Assignee: Rawlings Sporting Goods, Inc., St. Louis, MO (US)

( * ) Notice: Subject to any disclaimer, the term of this patent is extended or adjusted under 35 U.S.C. 154(b) by 287 days.

(21) Appl. No.: 11/943,565

(22) Filed: Nov. 20, 2007

Related U.S. Application Data

(60) Provisional application No. 60/866,903, filed on Nov. 22, 2006.

(51) Int. Cl.
*A63B 59/02* (2006.01)
*A63B 65/12* (2006.01)

(52) U.S. Cl. ..... 473/513; 473/512; 473/505; D21/724

(58) Field of Classification Search ..... 473/513, 473/512, 505; D21/724
See application file for complete search history.

(56) References Cited

U.S. PATENT DOCUMENTS 4,034,984 A * 7/1977 Crawford et al. ..... 473/513
4,037,841 A 7/1977 Lewis, Jr.
4,270,756 A 6/1981 Ahlenfeld et al.
5,178,397 A * 1/1993 Brine, Jr. ..... 473/513
5,568,925 A 10/1996 Morrow et al.
5,651,549 A 7/1997 Dill et al.
5,935,026 A 8/1999 Dill et al.
6,066,056 A 5/2000 Morrow
6,561,932 B2 5/2003 Morrow et al.
6,723,134 B2 * 4/2004 Tucker, Sr. ..... 473/513
6,852,047 B2 * 2/2005 Tucker, Sr. ..... 473/513
7,214,150 B2 * 5/2007 Filice et al. ..... 473/513

* cited by examiner

*Primary Examiner*—Gene Kim
*Assistant Examiner*—M Chambers
(74) *Attorney, Agent, or Firm*—Waddey & Patterson PC; Phillip E. Walker

(57) ABSTRACT

A lacrosse head comprising a frame, a plurality of vertical attachment projections, and a pocket. The frame includes a pair of sidewalls with each sidewall including an exterior surface and an interior surface. The vertical attachment projections are spaced along each sidewall wherein each vertical attachment projection is vertically attached to the interior surface of one of the sidewalls. The pocket is then attached to the vertical attachment projections.

18 Claims, 4 Drawing Sheets

LACROSSE HEAD WITH VERTICAL POCKET ATTACHMENTS

This application is a continuation application of co-pending U.S. Provisional Application No. 60/866,903 filed Nov. 22, 2006 entitled "Lacrosse Head with Vertical Pocket Attachments," which is hereby incorporated by reference in its entirety.

I, Paul Gait, a citizen of Canada, residing at 5 Normandy Drive, Altamont, N.Y. 12009, have invented a new and useful "Lacrosse Head With Vertical Pocket Attachments."

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

BACKGROUND OF THE INVENTION

It will be appreciated by those of ordinary skill in the art that lacrosse is a fast growing sport. It will further be appreciated that lacrosse heads are essential to playing the game. A lacrosse head is a collection, catching, or basket-type, element that attaches to the end of a handle, or lacrosse stick. The lacrosse head is usually molded from polymers, such as duPont Xytel brand nylon. The lacrosse head has an open, or upper, side for catching and discharging a ball and a lower side to which a net or pocket is attached for holding the ball. A lacrosse head has a throat section that includes a ball stop for impacting a ball and a socket for receiving the handle. A pair of sidewalls is attached to the throat section proximate the ball stop and are joined distal from the throat section by a lip or scoop.

In the game of lacrosse, the head is used to catch the ball, hold the ball, and pass or shoot the ball. To this end, there have been several attempts to improve the lacrosse head to enhance the playing of lacrosse.

For example, U.S. Pat. Nos. 4,037,841, 4,270,756, and 6,561,932 disclose the use of cushioning materials placed on the internal surfaces of a lacrosse frame near its base at the ball stop.

Prior art attempts have been made to reconfigure the sidewalls and the ball stop area to improve the performance of a lacrosse head. For example, U.S. Pat. Nos. 5,935,026 and 5,651,549 issued to Dill et al disclose a lacrosse head in which the majority of the head, all the head except for the portion of the head proximal to the throat, lies on a plane below the stick.

U.S. Pat. No. 5,568,925 discloses an upper wall and a lower wall in which both the upper wall and lower wall curve away from the plane, have a curved base, and then curve back toward the plane.

Some players desire a lacrosse head that is narrower at the opening than at the pocket area such as lacrosse head disclosed in U.S. Pat. No. 5,651,549. Other players desire a lacrosse head where the open side of the lacrosse head is larger than the net side of the lacrosse head such as the lacrosse head disclosed in U.S. Pat. Nos. 6,066,056 and 6,561,932. The '932 patent also discloses a recessed ball stop that creates an angular shoulder along the lower side. However, this angular shoulder causes some people to believe that the shoulder holds the ball too well and illegally impedes the ball from rolling out of the head. Further, a ball dynamically contacting the shoulder will do so on either a flat portion or an edge. Dynamic contact with the flat portion does not direct the ball into the net or pocket. Dynamic contact with the edge causes the ball to act in a less controllable and less predictable manner. Further, the '932 patent discloses sidewalls that are essentially vertically-flat until they curved outwardly between the middle and upper portion thereby creating a substantially flat section in the middle to lower portion. When the ball dynamically contacts this flat portion, the ball is directed toward the opposite sidewall.

Other prior art patents have tried to focus on the attachment between the pocket and the frame of a lacrosse head. These patents normally focus on the movement of the various cross-pieces, shooting strings, and runners of the pocket through the openings in the frame. Most of these prior arts attempts fail to appreciate various orientations of the tabs or protrusions extending from the frame to which the pocket is attached.

What is needed then is an improved lacrosse head having improved attachment design for the pocket to attach to the frame of a lacrosse head. This lacrosse head can improve the response of the pocket based upon the orientation of the attachment pieces to which the pocket connects to the head. This needed lacrosse head is presently lacking in the art.

BRIEF SUMMARY OF THE INVENTION

Disclosed herein is a lacrosse head comprising a frame, a plurality of vertical attachment projections, and a pocket. The frame includes a pair of sidewalls with each sidewall including an exterior surface and an interior surface. The vertical attachment projections are spaced along each sidewall wherein each vertical attachment projection is vertically attached to the interior surface of one of the sidewalls. The pocket is then attached to the vertical attachment projections.

Each projection defines an attachment projection opening that is substantially parallel to the length of the sidewall. Each attachment projection opening can be substantially parallel to the length of the sidewall at the connection location to which that particular projection is attached.

The frame further includes a plurality of sidewall pocket openings positioned on one of the sidewalls adjacent to one of the vertical attachment projections. Each sidewall pocket opening can be positioned to expose one of the vertical attachment projections to the exterior surface of the sidewall to which it is attached. Additionally, the frame can include intermediary sidewall openings wherein each intermediary sidewall opening is positioned between two of the sidewall pocket openings.

The pocket can further include a plurality of cross pieces wherein each cross piece traverses at least one of the sidewall pocket openings to attach the pocket to the frame. In addition the pocket can include at least one shooting string where the shooting string traverses one of these sidewall pocket openings to adjust the pocket with respect to the frame.

The frame can further include a scoop and a throat wherein the pocket is also attached to the scoop and the throat. Each sidewall can further include a top side wall support and a bottom side wall support wherein the vertical attachment projections are positioned on the bottom sidewall supports.

In a preferred embodiment the top side wall support and the bottom side wall support converge proximate the scoop while each sidewall expands outwardly away from the other sidewall proximate the scoop. At least one vertical convergent tab can be positioned to substantially span the convergence, or combined vertical width, of the top sidewall support and bottom sidewall support of the frame.

Additionally two of the vertical attachment projections can be positioned on opposite sidewalls substantially opposite from each other. These oppositely positioned vertical attachment projections can be separated by a vertical projection separation distance which is preferably greater than a minimal sidewall separation distance separating the first and second sidewalls, or alternately the minimal sidewall separation distance can be less than the vertical projection separation distance.

Also disclosed is a lacrosse head comprising a throat for receiving a handle and a scoop positioned distal from the throat. First and second sidewalls extend from the throat to the scoop wherein each sidewall includes an inner edge, an outer edge, a length, an upper portion, and a lower portion. First and second vertical tabs are attached to the inner surfaces of the lower portions of the first and second sidewalls respectively wherein each vertical tab is positioned vertically to intersect the length of the sidewall it is attached.

The first and second vertical tabs are positioned substantially opposite each other and include a vertical length and define a tab opening having a center wherein the center of the tab opening is substantially perpendicular to the vertical length at the location of attachment of each vertical tab. The pocket is attached through a plurality of cross pieces to the tab openings to attach the pocket to one of the sidewalls.

It is therefore a general object to provide an improved lacrosse head.

Another object of the present invention is to provide a lacrosse head having vertical attachment locations for the pocket.

Another object of the present invention is to provide a lacrosse head having attachment locations spaced by distances larger than the minimum distance separating the sidewalls of the lacrosse head.

Still another object of the present invention is to provide attachment locations for a pocket for a lacrosse head that do not substantially affect the entry or exit of a ball into the lacrosse head.

Other and further objects, features and advantages of the present invention will be readily apparent to those skilled in the art upon reading of the following disclosure when taken in conjunction with the accompanying drawings.

DETAILED DESCRIPTION OF THE INVENTION

Figure 1:
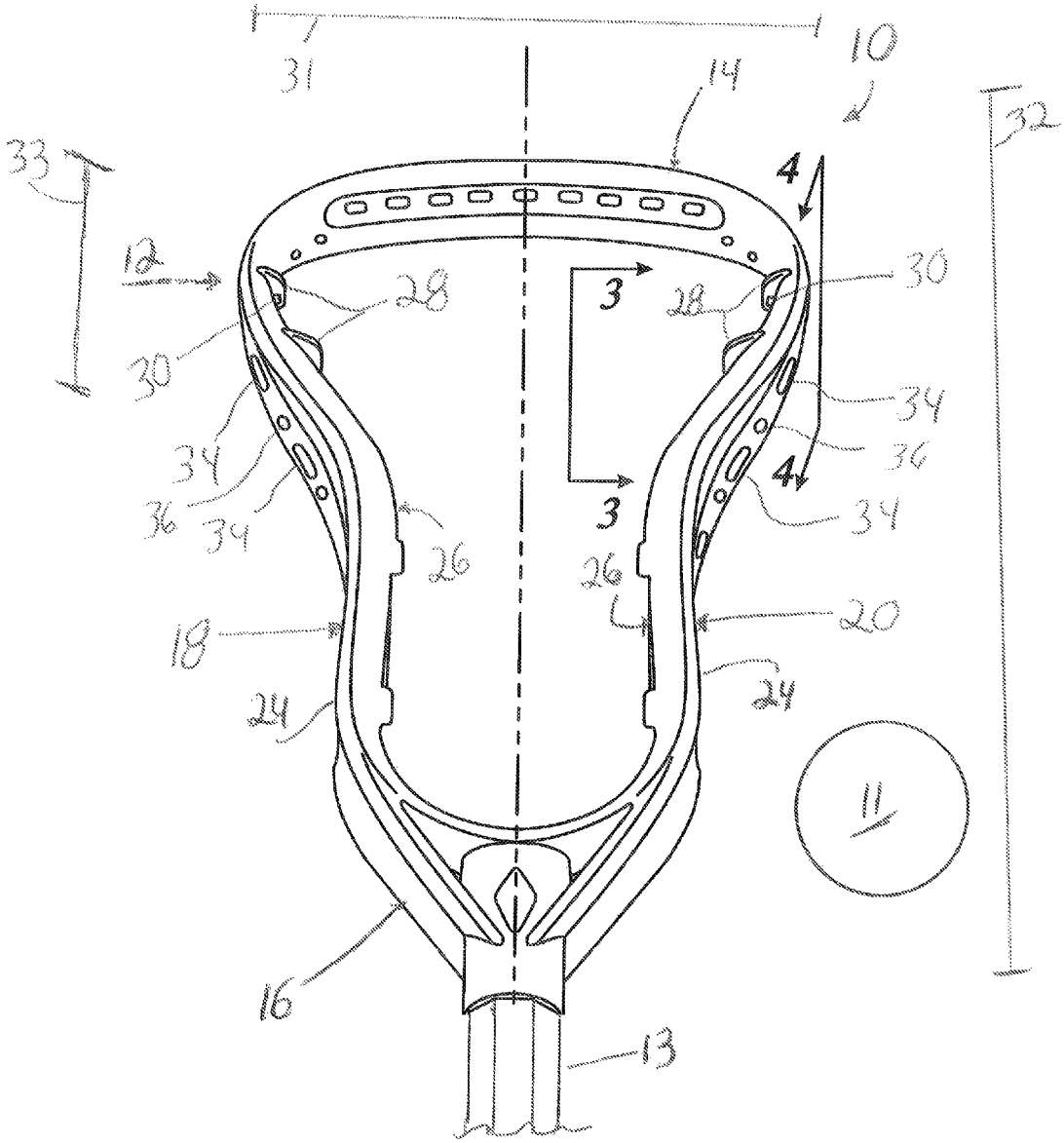
FIG. 1 is a top view of the frame of a lacrosse head made in accordance with the current disclosure.
Figure 2:
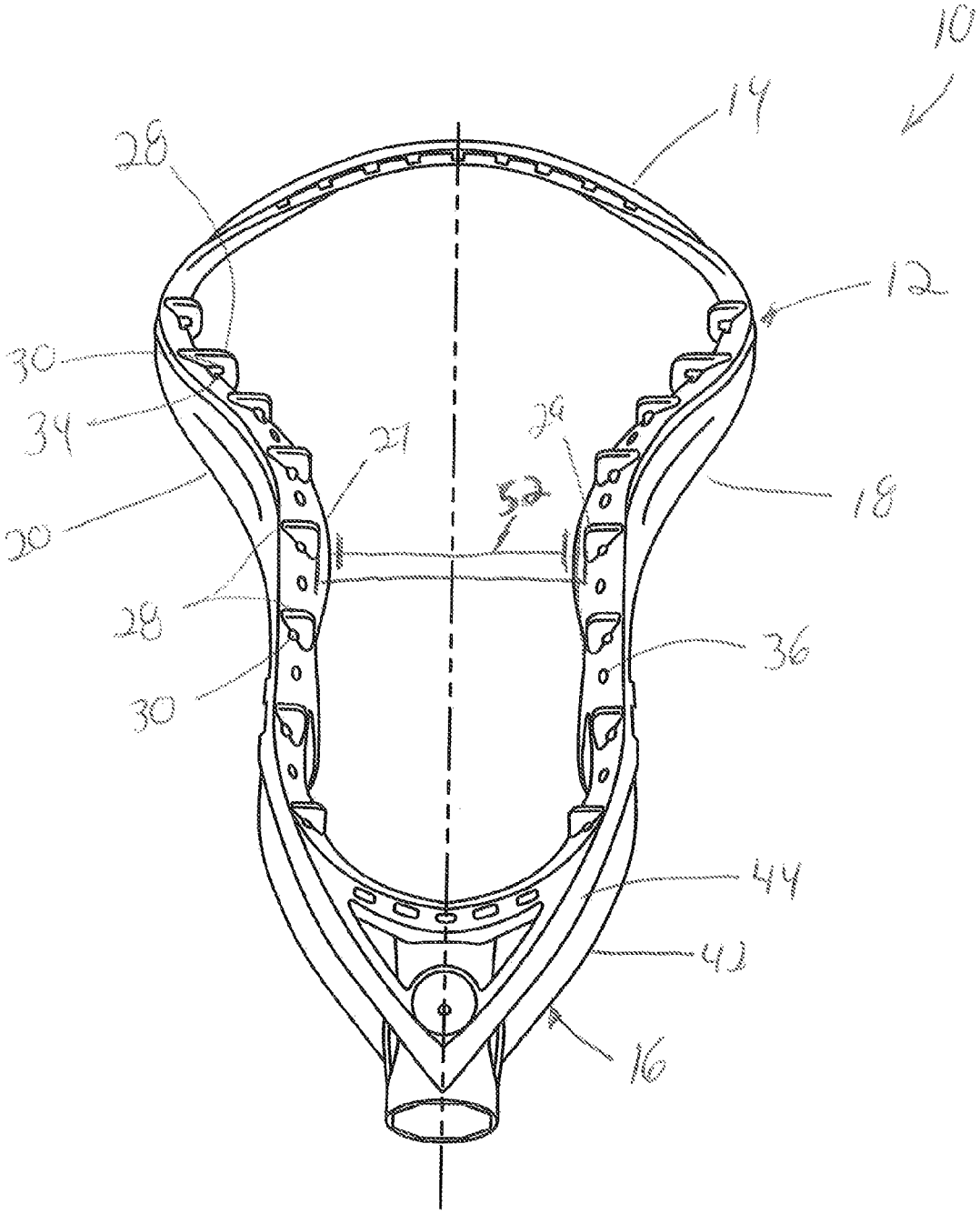
FIG. 2 is a bottom view of the lacrosse head shown in FIG. 1.
Figure 3:
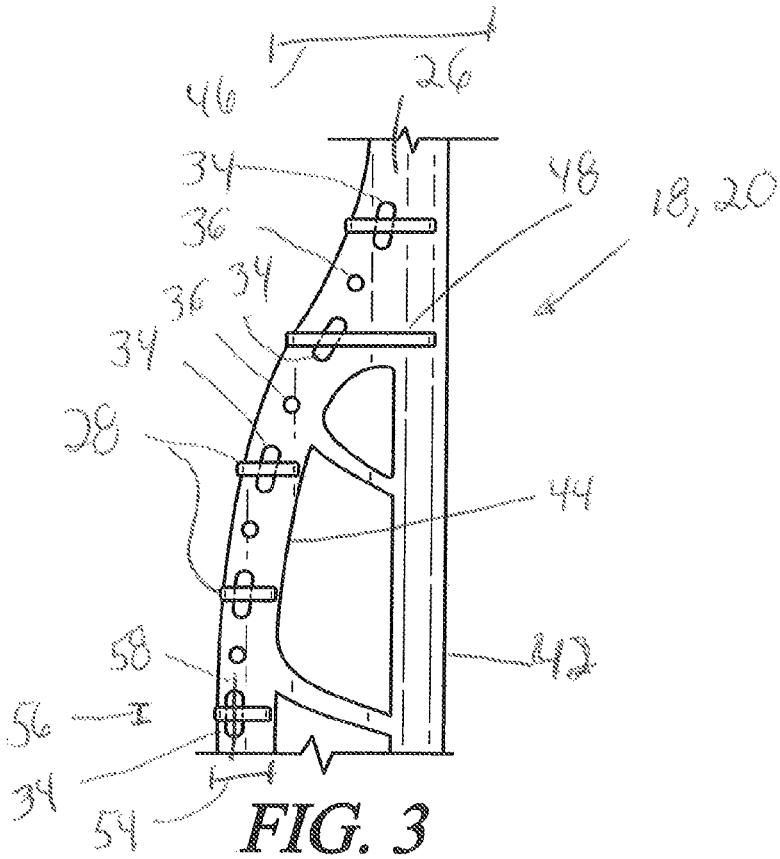
FIG. 3 is a view along line 3-3 of the lacrosse head shown in FIGS. 1-2
Figure 4:
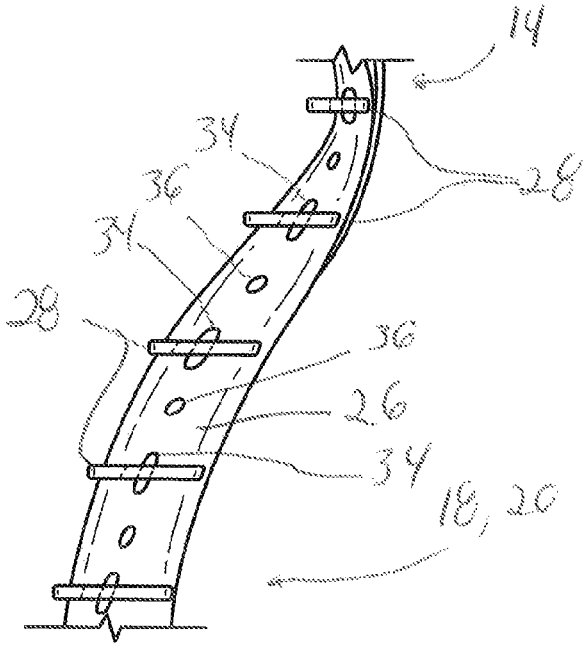
FIG. 4 is a view along line 4-4 of the lacrosse head shown in FIGS. 1-2
Figure 5:
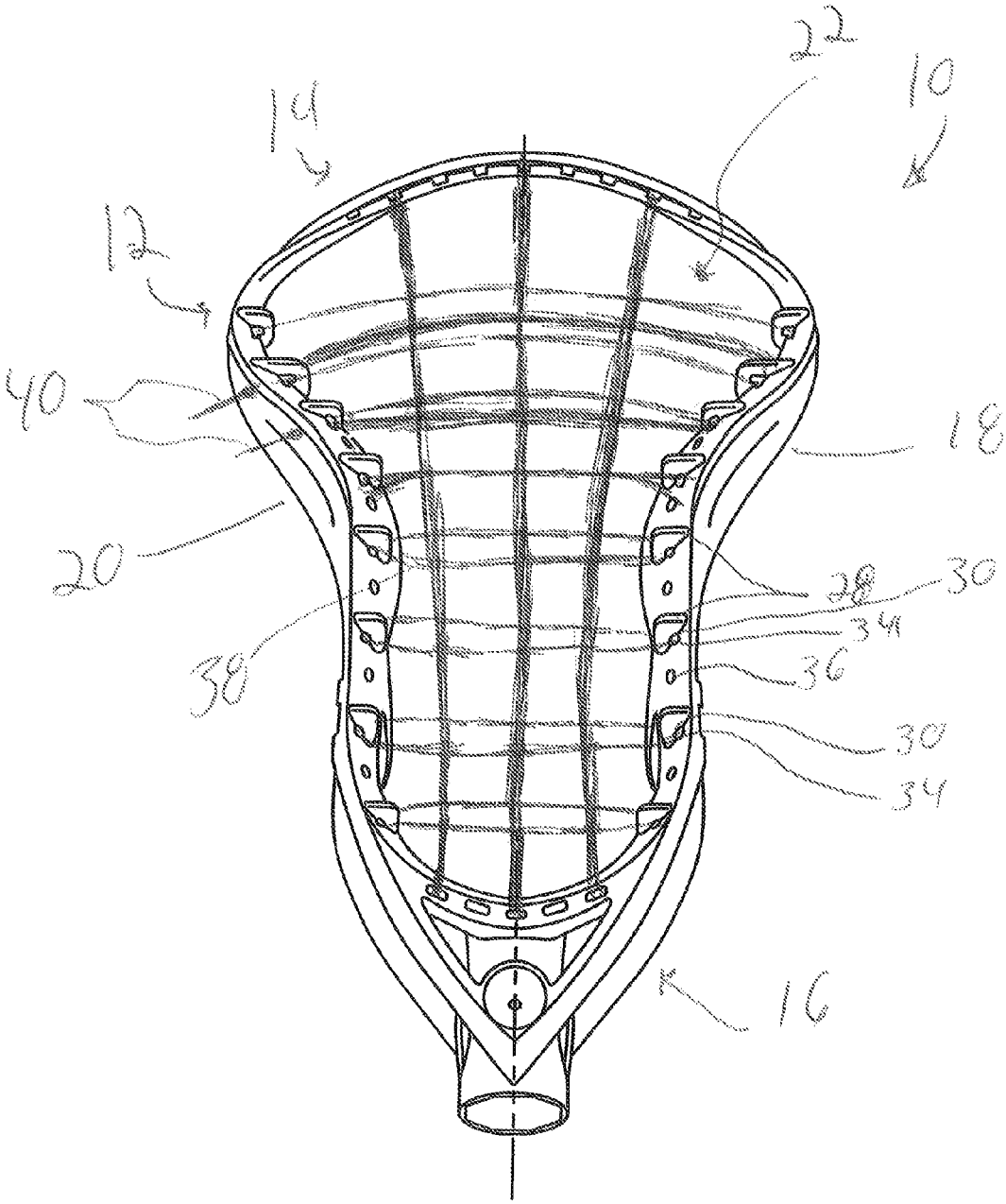
FIG. 5 is a bottom view similar to FIG. 2 showing a pocket attached to the lacrosse head.

Referring generally now to FIGS. 1-13, a lacrosse head is shown and generally designated by the numeral 10. The lacrosse head 10 includes a frame 12 having a scoop 14, a throat 16, and sidewalls 18 and 20. The lacrosse head 10 also includes a pocket 22, which can be described as webbing 22 or a net 22, attached to the frame 12. The lacrosse head 10 is attached to a handle 13 and is used to control a lacrosse ball 11.

Each sidewall 18 and 20 includes an exterior surface 24 and an interior surface 26. A plurality of vertical attachment projections 28 are spaced along each sidewall 18 and 20 wherein each vertical attachment projection 28 is vertically attached to the interior surface 26 of one of the sidewalls 18 or 20. The pocket 22 is attached to the vertical attachment projections 28.

In alternate description, the lacrosse head 10 has a length 32 measured in a direction from the scoop to the throat, a width 31 measured in a direction extending between the side walls and a depth 33 measured in a direction extending substantially perpendicular to the width 31, or in a direction extending from the open side of the lacrosse head to the pocket side of the lacrosse head 10. The vertical attachment projections 28 can be described as being oriented to be substantially parallel with the depth 33 of the lacrosse head 10.

In a preferred embodiment each vertical attachment projection 28, which can also be described as a vertical tab 28 defines a attachment projection opening 30, or tab opening 30 that is substantially parallel to the length 32 of the sidewall 18 or 20 to which it is attached. Each tab opening 30 can further be positioned to be substantially parallel to the shortened segment of the length 32 at which the vertical tab 28 is attached along each sidewall 18 or 20. Alternately described, the verticality of the vertical tabs 28 can vary their orientation as the sidewalls 18 or 20 vary there verticality with respect to the rest of the frame 12.

The frame 12 can further include a plurality of sidewall pocket openings 34 wherein each sidewall pocket opening 34 can be positioned on one of the sidewalls 18 or 20 adjacent to one of the vertical tabs 28. Each sidewall pocket opening 34 can be positioned to expose one of the vertical tabs 28 to the exterior surface 24 of the sidewall 18 or 20. As such, a portion of the pocket 22 can extend through the tab opening 30 and the sidewall pocket opening 34 and passed to the exterior surface 24 of the frame 12. Additionally the frame 12 can include a plurality of intermediary sidewall openings 36 wherein each intermediary opening 36 is positioned between two of the sidewall pocket openings 34.

Cross pieces 38 of the pocket 22 can traverse the sidewall pocket openings 34 through the tab openings 30 to attach the pocket 22 to the frame 12. Adjacent cross pieces can also directly engage the intermediary openings 36. Shooting strings 40 can also traverse the tab openings 30 and sidewall pocket openings 34 to adjust the pocket 22 with respect to the frame 12. Alternately the shooting strings 40 can engage the intermediary openings 36. The pocket 22 can have traditional, or non-traditional, attachments to the scoop 14 and throat 16.

Each sidewall 18 and 20 can further include a top sidewall support 42 and a bottom sidewall support 44. The top sidewall support 42, which can also be described as an upper portion 42, is preferably spaced from the bottom sidewall support 44, which can also be described as a lower portion 44, along a majority of the length 32 of each sidewall 18 or 20. The vertical tabs 28 are preferably attached to and positioned on the lower portion 44 and intersect the length 32 of the lower portion 44 of one of the sidewalls 18 or 20. The upper and lower portions 42 and 44 converge proximate the scoop 14 and expand outwardly away from each other proximate the scoop 14. This convergence includes a combined vertical width 46 at the convergence. A vertical convergence tab 48 can substantially span the combined vertical width 46 to further facilitate attachment of the pocket 22 to the frame 12 and strengthen those portions of the frame 12.

In a preferred design, two tabs 27 and 29 are preferably attached to the interior surface 26, which can also be described as the inside 26, of the lower portion 44 of the sidewalls 18 or 20. The first vertical tab 27 is positioned substantially opposite the second vertical tab 29. The tabs 27 and 29 are separated by a vertical tab separation distance 50. A minimum sidewall separation distance 52 separates the first and second sidewalls 18 and 20 and vertical tab separation distance 50 is greater than the minimum sidewall separation distance 52. This substantially positions the vertical tabs 28 away from interference with a ball 11 as the ball 11 is caught in the lacrosse head 10. The vertical tabs 28 can still be used to maintain some control over the ball 11 when it is positioned in the pocket 22 in a lacrosse head 10.

Each vertical tab 28 can include a vertical length 54 and a horizontal width 56, which can define the tab opening 30. Each tab opening 30 can include a center 58 that can be substantially perpendicular to the vertical length 54. The center 58 of the vertical tabs 30 can be exposed to the outside 24 of one of the sidewalls 18 or 20 by one of the sidewall pocket openings 34.

Thus, although there have been described particular embodiments of the present invention of a new and useful LACROSSE HEAD WITH POCKET VERTICAL ATTACHMENTS, it is not intended that such references be construed as limitations upon the scope of this invention except as set forth in the following claims.

What is claimed is:

1. A lacrosse head comprising:

a frame including a pair of side walls, each side wall including an exterior surface and an interior surface;

a plurality of vertical attachment projections spaced along each side wall, each vertical attachment projection vertically attached to the interior surface of one of the side walls;

a pocket attached to the vertical attachment projections wherein each side wall pocket opening is positioned to expose one of the vertical attachment projections to the exterior surface of one of the side walls.

2. The lacrosse head of claim 1, each projection further defining an attachment projection opening and each side wall including a length, wherein each attachment projection opening is substantially parallel to the length of one of the side walls.

3. The lacrosse head of claim 2, the frame further including a plurality of side wall pocket openings each side wall pocket opening positioned on one of the side walls adjacent to one of the vertical attachment projections.

4. The lacrosse head of claim 1, the frame further including a plurality of intermediary side wall openings, each intermediary side wall opening positioned between two of the side wall pocket openings.

5. The lacrosse head of claim 2, the pocket further including a plurality of cross pieces, each cross piece traversing at least one of the side wall pocket openings to attach the pocket to the frame.

6. The lacrosse head of claim 2, the pocket further including at least one shooting string, the at least one shooting string traversing at least one of the side wall pocket openings to adjust the pocket with respect to the frame.

7. The lacrosse head of claim 1, wherein the frame includes a scoop and a throat and the pocket is attached to the scoop and the throat.

8. The lacrosse head of claim 1, each side wall further including a top side wall support and a bottom side wall support, the plurality of vertical attachment projections positioned on the bottom side wall supports.

9. A lacrosse head comprising:

a throat for receiving a handle;

a scoop distal from the throat;

a first and second side walls extending from the throat to the scoop, each side wall having an inside, an outside, a length, an upper portion, and a lower portion; and a first vertical tab positioned vertically to intersect the length of one of the side walls and attached to the interior surface of the lower portion of the first side wall wherein the first vertical tab defining a tab opening having a center, the center of the tab opening substantially perpendicular to the first vertical tab.

10. The lacrosse head of claim 9, further including a pocket including a plurality of cross pieces, wherein at least one of the cross pieces traverses the tab opening to attach the pocket to the frame.

11. The lacrosse head of claim 9, wherein:

the upper and lower portion of each side wall converges proximate the scoop and each side wall expands outwardly from the other side wall, the convergence including a combined vertical width; and further including at least one vertical convergence tab substantially spanning the combined vertical width.

12. The lacrosse head of claim 9, further including:

a second vertical tab attached to the inside of the lower portion of the second side wall and positioned substantially opposite the first vertical tab;

a vertical tab separation distance separating the first and second tabs;

a minimum side wall separation distance separating the first and second side walls; and wherein the vertical tab separation distance is greater than the minimum side wall separation distance.

13. A lacrosse head comprising:

a throat for receiving a handle;

a scoop distal from the throat;

a first and second side walls extending from the throat to the scoop, each side wall having an inside, an outside, a length, an upper portion, and a lower portion;

a first vertical tab attached to the interior surface of the lower portion of the first side wall and positioned vertically to intersect the length of the first side wall;

a second vertical tab attached to the interior surface of the lower portion of the second side wall substantially opposite the first vertical tab and positioned vertically to intersect the length of the second side wall;

each vertical tab including a vertical length and defining a tab opening having a center, the center of the tab opening substantially perpendicular to the vertical length; and a pocket including a plurality of cross pieces, the at least one of the cross pieces traverses one of the tab opening to attach the pocket to one of the side walls wherein the first side wall further including a first side wall pocket opening and the second side wall further including a second side wall pocket opening, each side wall pocket opening positioned on one of the side walls and aligned with one of the vertical tabs to expose the center of that vertical tab to the outside of that side wall.

14. The lacrosse head of claim 13, the pocket further including at least one shooting string, the at least one shooting string traversing at least one of the side wall pocket openings to adjust the pocket with respect to that side wall.

15. The lacrosse head of claim 13, wherein:

the upper and lower portion of each side wall converges proximate the scoop and each side wall expands outwardly from the other side wall, the convergence including a combined vertical width; and further including at least one vertical convergence tab substantially spanning the combined vertical width.

16. The lacrosse head of claim 13, further including:

a vertical tab separation distance separating the first and second tabs;

a minimum side wall separation distance separating the first and second side walls; and wherein the minimum side wall separation distance is less than the vertical tab separation distance.

17. A lacrosse head comprising:

a throat for receiving a handle;

a scoop distal from the throat;

a first and second side walls extending from the throat to the scoop, each side wall having an inside, an outside, a length, an upper portion, a lower portion, and a side wall pocket opening, a minimum side wall separation distance separating the first and second side walls;

a first vertical tab attached to the interior surface of the lower portion of the first side wall and positioned vertically to intersect the length of the first side wall;

a second vertical tab attached to the interior surface of the lower portion of the second side wall substantially opposite the first vertical tab and positioned vertically to intersect the length of the second side wall;

each vertical tab including a vertical length and defining a tab opening having a center, the center of the tab opening substantially perpendicular to the vertical length, a vertical tab separation distance separating the first and second tabs;

a pocket including a plurality of cross pieces, the at least one of the cross pieces traverses one of the tab opening to attach the pocket to one of the side walls;

each side wall pocket opening positioned on one of the side walls and aligned with one of the vertical tabs to expose the center of that vertical tab to the outside of that side wall; and wherein the vertical tab separation distance is greater than the minimum side wall separation distance.

18. The lacrosse head of claim 17, wherein:

the upper and lower portion of each side wall converges proximate the scoop and each side wall expands outwardly from the other side wall, the convergence including a combined vertical width; and further including at least one vertical convergence tab substantially spanning the combined vertical width.

* * * * *